US007387194B2

(12) United States Patent
Skolnick

(10) Patent No.: US 7,387,194 B2
(45) Date of Patent: Jun. 17, 2008

(54) AUTOMATIC PASSENGER CONVEYOR SLOW SPEED OPERATION

(75) Inventor: Steven M. Skolnick, Simsbury, CT (US)

(73) Assignee: Otis Elevator Company, Farmington, CT (US)

( * ) Notice: Subject to any disclaimer, the term of this patent is extended or adjusted under 35 U.S.C. 154(b) by 82 days.

(21) Appl. No.: 10/577,878

(22) PCT Filed: Nov. 4, 2003

(86) PCT No.: PCT/US03/35089

§ 371 (c)(1),
(2), (4) Date: Apr. 28, 2006

(87) PCT Pub. No.: WO2005/047142

PCT Pub. Date: May 26, 2005

(65) Prior Publication Data

US 2007/0023256 A1 Feb. 1, 2007

(51) Int. Cl.
*B66B 21/00* (2006.01)

(52) U.S. Cl. ..... 198/322; 198/323

(58) Field of Classification Search ..... 198/321–324, 198/334

See application file for complete search history.

(56) References Cited

U.S. PATENT DOCUMENTS 4,232,776 A * 11/1980 Dean ..... 198/322
4,326,622 A * 4/1982 Ellzey ..... 198/322
5,622,246 A 4/1997 Kubota
5,708,416 A * 1/1998 Zaharia et al. ..... 198/322
6,138,815 A 10/2000 Reiners et al.
6,490,979 B1 12/2002 Pfleger et al.
6,626,279 B2 * 9/2003 Henkel et al. ..... 198/322
2003/0051947 A1 3/2003 Friedli

FOREIGN PATENT DOCUMENTS

JP 404365787 * 12/1992 ..... 198/322
JP 11263574 A 9/1999
JP 2000 198651 A 7/2000
JP 2000 351566 A 12/2000
JP 2002 104761 A 4/2002

OTHER PUBLICATIONS

International Search Report dated Apr. 21, 2004 relating to PCT/US03/35089.
International Preliminary Examination Report date Aug. 12, 2004 relating to PCT/US03/35089.

* cited by examiner

*Primary Examiner*—James R Bidwell
(74) *Attorney, Agent, or Firm*—Carlson, Gaskey & Olds

(57) ABSTRACT

A passenger conveyor system (20) automatically reduces the speed of the conveyor responsive to a request from one or more potential passengers. In one example, a controller (32) receives information regarding a wirelessly transmitted signal (42) received by a receiver (34). The controller (32) gradually reduces the speed of the conveyor for a travel time of such a passenger and then subsequently gradually increases the speed to the normal operating speed. A variety of signaling devices (40) may be used and preferably are portable and carried about by individuals so that a separate mechanical switch need not be made part of the physical conveyor system.

26 Claims, 1 Drawing Sheet

AUTOMATIC PASSENGER CONVEYOR SLOW SPEED OPERATION

FIELD OF THE INVENTION

This invention generally relates to controlling passenger conveyor systems. More particularly, this invention relates to reducing the speed of a passenger conveyor system in an automated fashion.

DESCRIPTION OF THE RELATED ART

Passenger conveyor systems, such as moving walkways or escalators, typically include a plurality of steps that follow a loop to carry passengers between landings. The speed at which the conveyor steps move can present a difficulty for some potential passengers as they enter or exit the conveyor. For example, the elderly and small children may experience difficulty accessing a conveyor or may choose some other route to avoid potential difficulties getting on or off the conveyor.

It has been proposed to use a manual key switch to allow an individual to slow down an escalator. The document JP 2000198651 A, for example, shows an arrangement where a switch is positioned near an entrance point to an escalator, which can be manually activated by an individual to request a reduced speed of the escalator. While such systems may be useful, they are subject to improper use or vandalism. Additionally, there is some inconvenience associated with such arrangements and the additional floor space required is undesirable for some building owners, especially where floor space is at a premium.

There is a need for an improved arrangement for controlling the speed of a passenger conveyor to accommodate the needs of a variety of passengers. This invention addresses that need while avoiding the shortcomings and drawbacks of prior attempts.

SUMMARY OF THE INVENTION

In general terms, this invention is an automated arrangement for reducing the speed of a passenger conveyor to meet the needs of an individual passenger.

One system designed according to this invention includes a plurality of steps that follow a path to carry passengers between landings. A drive machine propels the steps in a desired manner. A controller controls operation of the drive machine to control the speed of movement of the steps. A receiver receives a wirelessly transmitted signal indicating a desire for a reduced conveyor speed. The controller reduces the speed of the steps responsive to the received signal.

In one example, the controller determines an estimated travel time of an individual providing the signal indicating the desire for reduced speed. The controller preferably controls the drive machine to maintain a reduced speed for the travel time of the passenger so the passenger can more easily enter and exit the conveyor. In one example, the controller uses information regarding the length of the path followed by the passenger on the conveyor and the speed of movement of the steps to determine the travel time.

In one example, a portable remote signaling device provides a wireless signal to the conveyor system indicating the desire for reduced speed. In one example, the signaling device is passive and does not require any activation by a user. In another example, the signaling device includes at least one switch that is selectively actuated by a user to provide the reduced speed request signal.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figures 1, 2:
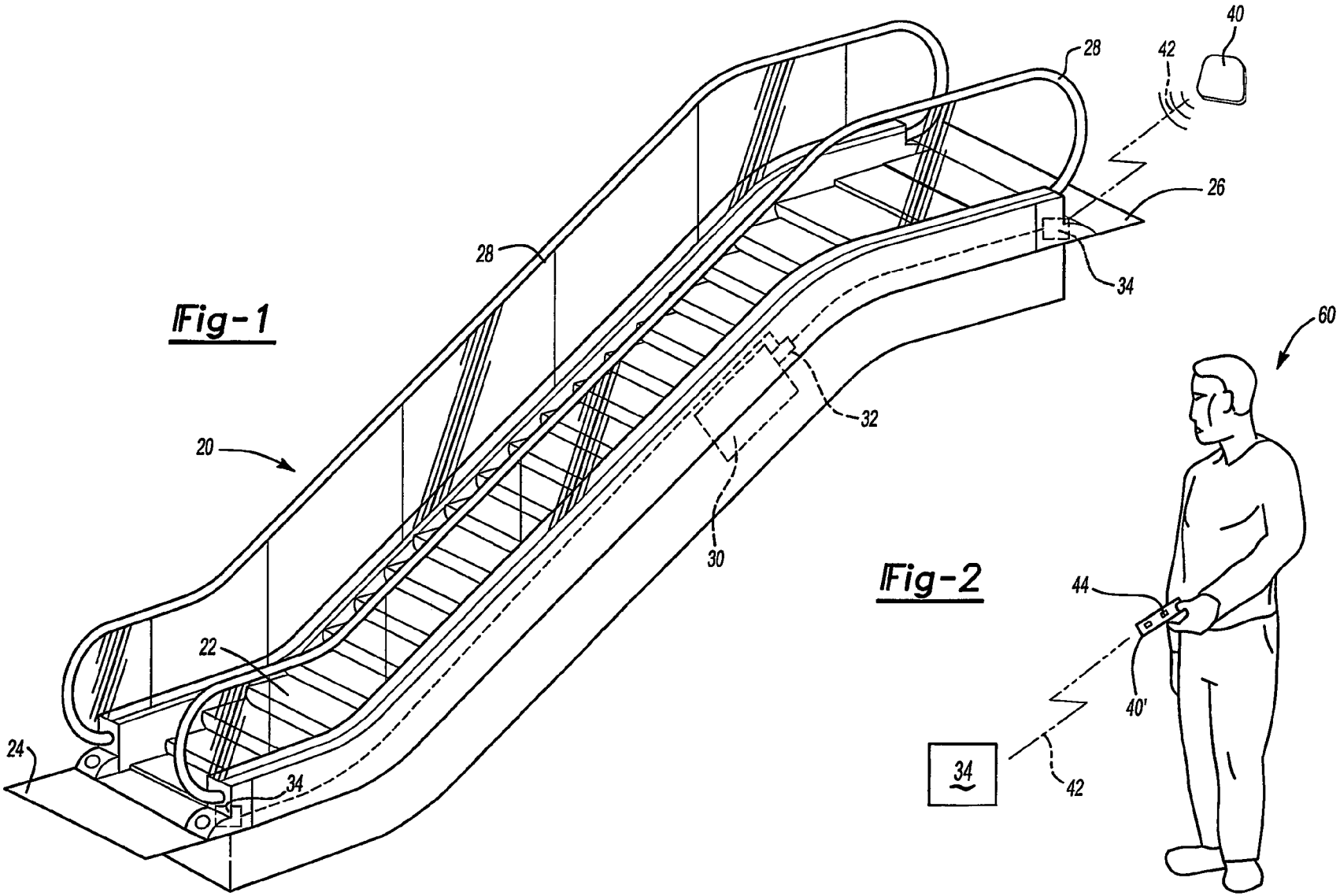
FIG. 1 schematically illustrates an escalator system incorporating a control arrangement designed according to an embodiment of this invention.
FIG. 2 schematically illustrates an individual utilizing an example signaling device for providing a reduced speed request signal useful with an embodiment of this invention.

FIG. 1 schematically illustrates a passenger conveyor 20, which is an escalator in this example. This invention is equally applicable to moving walkways or other forms of passenger conveyors. The conveyor 20 includes a plurality of steps 22 that follow a path between landings 24 and 26 to carry passengers between the landings. A handrail 28 moves with the steps 22 in a known manner.

A drive machine 30 propels the steps in a known manner. A controller 32 controls operation of the drive machine 30 to provide a desired speed and direction of travel of the conveyor. The controller 32 preferably is programmed to vary the speed of movement of the steps 22 to accommodate the needs of a variety of passengers.

The illustrated example includes receivers 34 near each end of the conveyor. In this example, the receivers 34 are positioned near the handrail entry points at each landing. The receivers 34 communicate with the controller 32 to provide an indication of when at least one passenger desires a reduced speed of movement of the steps 22.

FIG. 1 includes a remote signaling device 40 that provides a wireless signal 42 that is transmitted to at least one of the receivers 34. The signal 42 provides an indication that a passenger desires or requires a reduced speed of movement of the steps 22 to allow the passenger to more readily access the conveyor 20. Once the signal is received by a receiver 34, information is provided to the controller 32 indicating the reduced speed request. The controller 32 responds to the reduced speed request signal by gradually slowing down the speed of the conveyor, which allows an individual to more readily access the conveyor.

The controller 32 preferably controls the drive machine 30 to gradually change speeds (either increasing or decreasing) so that individuals already on the conveyor do not experience any bumps or jolts that may disturb them or be noticeable such that the operation of the conveyor seems of low quality.

In the example of FIG. 1, the signaling device 40 is a passive device that does not require any activation by a user. FIG. 2 schematically illustrates another example signaling device 40' that includes at least one switch 44 that is selectively activated by a user 60 to provide the reduced speed request signal 42. A variety of signaling devices are useful with a system designed according to this invention. Those skilled in the art who have the benefit of this description will realize which signaling device will best meet the needs of their particular situation. In one example, infrared signals are used. In another example, radio frequency signals are used.

The controller 32 preferably controls the speed of movement of the steps 22 for a period of time corresponding to an estimated travel of an individual providing the reduced speed request signal. In one example, the controller 32 knows the speed at which the steps move and has information regarding the length of travel between the landings 24 and 26. The controller 32 in this example uses such information to estimate a travel time and maintains the reduced speed for a period corresponding to the travel time. In one example, the reduced speed is maintained longer than the estimated travel time to accommodate any delays in the passenger entering or exiting the conveyor.

In one example, where the conveyor length is substantial enough to accommodate multiple changes in the speed of movement within the passenger's travel time, the controller reduces the speed near a beginning of the travel time, increases the speed during a middle portion of the travel time and then again reduces the speed near an end of the travel time. Such an arrangement allows for providing quick enough service to passengers who do not require the reduced speed for entry or exit and also accommodates the needs of the passenger having a need for reduced speed.

In the illustrated example, the receivers 34 are positioned near each end of the conveyor. In one example, the controller 32 slows down the conveyor speed responsive to receiving a signal at one of the receivers 34 and maintains the reduced speed until the same signal is received by the receiver 34 at the opposite end of the conveyor. In this example, the controller uses information regarding the position of the signaling device 40 relative to the conveyor to determine when the passenger is entering and existing the conveyor, respectively.

In one example, the controller receives a reduced speed request signal and determines the travel time of the passenger. The controller then continues to check for the most recent reduced speed request signal and maintains the reduced speed for a travel time corresponding to the most recently received signal. In this example, the controller avoids speeding the conveyor up during a period where a passenger having a reduced speed request subsequently enters the escalator during the travel time of a previous requesting passenger.

Accordingly, this invention provides an automated arrangement for reducing the speed of a passenger conveyor to meet the needs of one or more passengers who may otherwise have difficulty accessing the conveyor. The controller 32 and receivers 34 are schematically illustrated as separate components in FIG. 1, however, it should be noted that a variety of component arrangements are within the scope of this invention. Those skilled in the art who have the benefit of this description will be able to select appropriate components and to suitably program a controller to perform according to the needs of their particular situation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A passenger conveyor system, comprising:

a plurality of steps that follow a loop;

a drive machine that propels the steps in a desired manner;

a controller that controls operation of the drive machine; and a receiver for receiving a wireless signal indicating a need to reduce a speed of movement of the steps corresponding to a passenger desire for a reduced speed of movement of the steps to allow the passenger to more readily access the conveyor, the controller reducing the speed responsive to the received signal.

2. The system of claim 1, wherein the controller causes the drive machine to gradually change the speed of movement of the steps.

3. The system of claim 1, wherein the controller automatically increases the speed at a time corresponding to a time when a passenger providing the received signal exits the conveyor.

4. The system of claim 3, wherein the controller determines a travel time on the conveyor for a passenger providing the received signal and maintains the reduced speed for a period corresponding to the travel time.

5. The system of claim 4, wherein the controller uses information regarding the speed of movement of the steps and the distance that the conveyor carries a passenger to determine the travel time.

6. The system of claim 3, wherein the controller reduces the speed of movement near a beginning of a passenger travel time, increases the speed during a middle portion of the travel time and again reduces the speed near an end of the travel time.

7. The system of claim 3, wherein the controller reduces the speed responsive to the received signal near one end of the conveyor and then increases the speed subsequent to receiving the same signal near an opposite end of the conveyor.

8. The system of claim 1, wherein the steps move along a path between landings at opposite ends of the path and including at least one receiver near each landing.

9. The system of claim 1, including a portable signaling device that provides the wireless signal and wherein the signaling device is passive such that the wireless signal is transmitted to the receiver without requiring user operation.

10. The system of claim 1, including a portable signaling device that provides the wireless signal and wherein the wireless signaling device includes at least one switch that is selectively activated by a user to transmit the signal.

11. A method of operating a passenger conveyor, comprising the steps of:

moving the conveyor at a first speed;

receiving a wirelessly transmitted signal indicating a desire for reduced conveyor speed corresponding to a passenger desire for a reduced speed of movement of the steps to allow the passenger to more readily access the conveyor; and reducing the speed responsive to the received signal.

12. The method of claim 11, including gradually changing the speed of movement of the steps.

13. The method of claim 11, including determining a travel time on the conveyor for a passenger providing the received signal and maintaining the reduced speed for a period corresponding to the travel time.

14. The method of claim 13, including determining the travel time based upon a speed of movement of the steps and the distance that the conveyor carries a passenger.

15. The method of claim 13, including reducing the speed of movement near a beginning of the travel time, increasing the speed during a middle portion of the travel time and again reducing the speed near an end of the travel time.

16. The method of claim 11, including reducing the speed responsive to the received signal near one end of the conveyor and then increasing the speed subsequent to receiving the same signal near an opposite end of the conveyor.

17. A system for controlling a speed of movement of a passenger conveyor, comprising:

a controller that commands a conveyor speed;

a remote signaling device that provides a wireless signal indicating a desire for a reduced conveyor speed corresponding to a passenger desire for a reduced speed of movement of the steps to allow the passenger to more readily access the conveyor; and a receiver in communication with the controller for providing the controller information regarding a signal received from the signaling device, the controller reducing the conveyor speed responsive to the information regarding the received signal.

18. The system of claim 17, wherein the signaling device comprises a portable transmitter that transmits the wireless signal.

19. The system of claim 17, including at least one receiver near each end of the conveyor.

20. The system of claim 19, wherein the controller reduces the speed responsive to the received signal near one end of the conveyor and then increases the speed subsequent to receiving the same signal near an opposite end of the conveyor.

21. The system of claim 17, wherein the controller determines a travel time on the conveyor for a passenger providing the received signal and maintains the reduced speed for a period corresponding to the travel time.

22. A passenger conveyor system, comprising:

a plurality of steps that follow a loop;

a drive machine that propels the steps in a desired manner;

a controller that controls operation of the drive machine; and a receiver for receiving a wireless signal indicating a need to reduce a speed of movement of the steps, the controller reducing the speed responsive to the received signal and automatically increasing the speed at a time corresponding to a time when a passenger providing the received signal exits the conveyor.

23. A method of operating a passenger conveyor, comprising the steps of:

moving the conveyor at a first speed;

receiving a wirelessly transmitted signal indicating a desire for reduced conveyor speed;

reducing the speed responsive to the received signal; and determining a travel time on the conveyor for a passenger providing the received signal and maintaining the reduced speed for a period corresponding to the travel time.

24. A method of operating a passenger conveyor, comprising the steps of:

moving the conveyor at a first speed;

receiving a wirelessly transmitted signal indicating a desire for reduced conveyor speed;

reducing the speed responsive to the received signal; and reducing the speed responsive to the received signal near one end of the conveyor and then increasing the speed subsequent to receiving the same signal near an opposite end of the conveyor.

25. A system for controlling a speed of movement of a passenger conveyor, comprising:

at least one receiver near each end of the conveyor;

a controller that commands a conveyor speed;

a remote signaling device that provides a wireless signal indicating a desire for a reduced conveyor speed; and a receiver in communication with the controller for providing the controller information regarding a signal received from the signaling device, the controller reducing the conveyor speed responsive to the information regarding the received signal near one end of the conveyor and then increasing the speed subsequent to receiving the same signal near an opposite end of the conveyor.

26. A system for controlling a speed of movement of a passenger conveyor, comprising:

a controller that commands a conveyor speed;

a remote signaling device that provides a wireless signal indicating a desire for a reduced conveyor speed; and a receiver in communication with the controller for providing the controller information regarding a signal received from the signaling device, the controller reducing the conveyor speed responsive to the information regarding the received signal, determining a travel time on the conveyor for a passenger providing the received signal and maintaining the reduced speed for a period corresponding to the travel time.

* * * * *